US012455152B2

(12) United States Patent
Huang et al.

(10) Patent No.: US 12,455,152 B2
(45) Date of Patent: Oct. 28, 2025

(54) INTRINSIC-SAFETY EXPLOSIVE DISPOSAL AND PROTECTION DEVICE AND USING METHOD THEREFOR

(71) Applicant: BEIJING INSTITUTE OF TECHNOLOGY, Beijing (CN)

(72) Inventors: Guangyan Huang, Beijing (CN); Xiaobing Bian, Beijing (CN); Tao Wang, Beijing (CN); Ying Zhou, Beijing (CN)

(73) Assignee: BEIJING INSTITUTE OF TECHNOLOGY, Beijing (CN)

( * ) Notice: Subject to any disclaimer, the term of this patent is extended or adjusted under 35 U.S.C. 154(b) by 0 days.

(21) Appl. No.: 18/787,156

(22) Filed: Jul. 29, 2024

(65) Prior Publication Data

US 2025/0027758 A1 Jan. 23, 2025

Related U.S. Application Data

(63) Continuation of application No. PCT/CN2022/083881, filed on Mar. 30, 2022.

(30) Foreign Application Priority Data

Jan. 29, 2022 (CN) ..... 202210110946.8

(51) Int. Cl.
*F42D 5/04* (2006.01)
*F42D 5/045* (2006.01)

(52) U.S. Cl.
CPC ..... *F42D 5/045* (2013.01)

(58) Field of Classification Search
CPC .. F42D 5/04; F42D 5/045; F42B 39/14; F42B 39/24
USPC ..... 86/50
See application file for complete search history.

(56) References Cited

U.S. PATENT DOCUMENTS 3,611,766 A * 10/1971 Klein et al. ..... F42D 3/00 72/56
5,345,784 A * 9/1994 Bazemore ..... F25D 3/08 D7/605
5,390,580 A * 2/1995 Gibbons, Jr. ..... F42B 39/14 89/34
7,204,183 B2 * 4/2007 Cirillo ..... F42B 39/14 86/50

(Continued)

*Primary Examiner* — Joshua E Freeman
(74) *Attorney, Agent, or Firm* — Yong Chen

(57) ABSTRACT

An intrinsic-safety explosive disposal and protection device is incapable of causing secondary damage itself during excessive explosion or extreme conditions and capable of realizing efficient absorption for energy from explosion shock waves. The device includes an explosion-proof top cover, a support plate, an explosion-proof material filling layer and an explosion-proof drum; the explosion-proof drum is of a drum body structure having openings in two ends; the explosion-proof top cover is disposed on a top opening of the explosion-proof drum; the support plate is supported inside the explosion-proof drum, a height of the support plate in the explosion-proof drum is adjustable, and an area located below the support plate in the explosion-proof drum is a placing area for the explosive. An explosion-proof material is filled between the support plate in the explosion-proof drum and the explosion-proof top cover to form the filling layer. Use of the device is also provided.

12 Claims, 6 Drawing Sheets

(56) References Cited

U.S. PATENT DOCUMENTS

| | | | | |
|---|---|---|---|---|
| 7,213,494 | B2 * | 5/2007 | James | E04H 9/04 89/36.01 |
| 7,490,537 | B1 * | 2/2009 | Vande Brake | F42D 5/045 86/50 |
| 8,413,564 | B1 * | 4/2013 | Genovese | F42D 5/045 102/303 |
| 8,839,704 | B2 * | 9/2014 | Baum | F42B 39/16 86/50 |
| 10,539,404 | B1 * | 1/2020 | Lustig | B65F 1/04 |
| 10,914,564 | B1 * | 2/2021 | Wilhelm | F42B 39/24 |
| 10,962,342 | B1 * | 3/2021 | Wilhelm | F42B 39/24 |
| 11,852,451 | B2 * | 12/2023 | Huang | F42D 5/045 |
| 2003/0213802 | A1 * | 11/2003 | Reynolds | B65F 1/1607 220/62.15 |
| 2004/0091181 | A1 * | 5/2004 | James | F42D 5/045 383/80 |
| 2004/0194614 | A1 * | 10/2004 | Wang | F42B 39/14 86/50 |
| 2005/0115384 | A1 * | 6/2005 | Reynolds | B65F 1/1607 86/50 |
| 2005/0223881 | A1 * | 10/2005 | Cirillo | F42D 5/045 86/50 |
| 2007/0119851 | A1 * | 5/2007 | James | F42B 39/20 220/88.1 |
| 2012/0305567 | A1 * | 12/2012 | Abbe | B65F 1/1623 220/810 |
| 2014/0323792 | A1 * | 10/2014 | Morris | C06B 21/0091 588/403 |
| 2015/0184982 | A1 * | 7/2015 | Peters | F42B 39/24 89/36.01 |
| 2019/0168961 | A1 * | 6/2019 | Keller | B65D 88/12 |
| 2022/0412714 | A1 * | 12/2022 | Derode | F42D 5/045 |
| 2023/0065269 | A1 * | 3/2023 | Gevedon | F42B 39/24 |

* cited by examiner

INTRINSIC-SAFETY EXPLOSIVE DISPOSAL AND PROTECTION DEVICE AND USING METHOD THEREFOR

FIELD

The present disclosure relates to a protection device, in particular to an explosive disposal and protection device, and belongs to the field of equipment for polices, military and public security.

BACKGROUND

Explosion has the characteristics of ultra-transient state, high-speed propagation and wide-range damage, and therefore, emergency disposal and protection for explosives have always been a key issue in the fields of public security and military security.

For a traditional explosion-proof design method and corresponding equipment, mainly adopted is a way of confronting the tough with toughness, in which a high-strength structure is mainly adopted to restrain an explosive so that shock waves are prevented from being transferred out; or the shock waves are blocked and reflected back so as not to cause damage to personnel and objects behind a barrier. Typical equipment such as an explosion-proof ball and an explosion-proof tank is generally made of a metal material; and under the conditions such as excessive explosion and solder joint failure caused by severe environmental changes, explosion shock waves lead to the disintegration of the structure itself, a large number of metal fragments fly out, and thus, wider-range damage is caused. From the perspective of safety design of an explosion-proof device, a device made of a hard material is not an intrinsic-safety (intrinsic safety means that production equipment or a production system itself is safe and cannot cause accidents even in the case of misoperation or failure) device.

In addition, traditional explosion-proof equipment is relatively bulky and is generally impossible to lift for non-contact shielding disposal, and therefore, for most of tradition-based explosive disposal and protection methods and explosion-proof equipment, a contact way is adopted for disposal. For example, an explosive is placed into the explosion-proof equipment in a way that the explosive is clamped by an explosive ordnance disposal rod or the explosive is grabbed by a robot. For an ordinary self-made explosive, there are more "unknown" attributes, such as an uncertain explosion equivalent, an uncertain initiation mode, an uncertain delivery mode and an uncertain damage range, which bring great trouble to public security departments, such as polices and armed polices. In addition, for standard ammunitions, torque sensors, mechanical rotation or vibration fuses are usually used. When the robot or explosive ordnance disposal rod is used to clamp the explosive for disposal, accidental explosion is likely to occur, which causes damage to surrounding personnel and objects. In view of a safe disposal operation process, a contact disposal way is not a safe disposal method in essence.

SUMMARY

To this end, the present disclosure provides an intrinsic-safety explosive disposal and protection device incapable of causing secondary damage itself during excessive explosion or extreme conditions and capable of realizing efficient absorption for energy from explosion shock waves, thereby implementing non-contact safety disposal for an explosive.

Provided is an intrinsic-safety explosive disposal and protection device, including an explosion-proof top cover, an explosion-proof material filling layer, an explosion-proof drum and an energy absorption plate which are prepared from a flexible composite material;

- the explosion-proof drum being of a drum body structure having openings in two ends;
- the explosion-proof top cover being disposed on a top opening of the explosion-proof drum; the energy absorption plate being disposed at a set height position inside the explosion-proof drum; and
- an explosion-proof material being filled between the energy absorption plate in the explosion-proof drum and the explosion-proof top cover to form the explosion-proof material filling layer.

As a preferred way of the present disclosure, the intrinsic-safety explosive disposal and protection device further includes a support plate; the support plate is disposed below the energy absorption plate in the explosion-proof drum, and an area located below the support plate in the explosion-proof drum is a placing area for an explosive; and a height of the support plate in the explosion-proof drum is adjustable.

As a preferred way of the present disclosure, the energy absorption plate includes an energy absorption plate main body, a top bullet-proof packaging material and a high-impedance and high-damping filling material;

- an annular groove is formed in a center of a surface of the energy absorption plate main body, trapezoidal holes are uniformly spaced and distributed in a circumferential direction of a periphery of the groove, and the trapezoidal holes are filled with an open-cell porous foam material;
- the groove in the surface of the energy absorption plate main body is filled with the high-impedance and high-damping filling material; and
- the top bullet-proof packaging material is a packaging material disposed on a top of the groove in the surface of the energy absorption plate main body and is used for packaging the high-impedance and high-damping filling material therein.

As a preferred way of the present disclosure, the explosion-proof top cover includes a top support layer, a top explosion-proof liquid layer and a top bullet-proof layer;

- an annular groove is disposed in an upper surface of the top support layer, an annular bulge is provided in a middle of the annular groove, and a height of the annular bulge is smaller than a depth of the annular groove;
- the top explosion-proof liquid layer is of an annular structure with a central through hole, is located in the annular groove in the upper surface of the top support layer, and sleeves the annular bulge in the annular groove;
- the top bullet-proof layer is of an annular flat plate structure and is disposed above the top explosion-proof liquid layer in the annular groove in the upper surface of the top support layer; and
- trapezoidal through holes are distributed in a position, corresponding to the top explosion-proof liquid layer, on a lower surface of the top support layer, and a depth of each of the trapezoidal through holes is consistent with a thickness of the top support layer at the corresponding position.

As a preferred way of the present disclosure, the explosion-proof drum is of a drum body structure with a variable wall thickness gradually increased from top to bottom; and an inner surface of the explosion-proof drum is a conical surface with a top wider than a bottom, and an outer surface thereof is a conical surface with a top narrower than a bottom.

As a preferred way of the present disclosure, the explosion-proof drum is sequentially provided with an inner support layer, an explosion-proof liquid layer, an inner bullet-proof layer, a laterally-filled energy absorption layer, an anti-jumping bullet-proof layer and a main body support from inside to outside;

the inner support layer is of an inverted trapezoidal structure, and a lower end thereof extends outwards to form a shaft shoulder; the inner bullet-proof layer is of a straight tubular structure coaxially sleeving the inner support layer, an inner surface of a lower end thereof is in contact linkage with the shaft shoulder at the lower end of the inner support layer, and an explosion-proof liquid is filled between the inner support layer and the inner bullet-proof layer to form an explosion-proof liquid layer B; an explosion-proof liquid layer A is disposed on a top of the inner bullet-proof layer, and the inner bullet-proof layer has the same height as the explosion-proof liquid layer A and the inner support layer;

the laterally-filled energy absorption layer is disposed outside the inner bullet-proof layer, and a bottom of the laterally-filled energy absorption layer is packaged by a bottom barrier layer;

the anti-jumping bullet-proof layer is disposed from bottom to top at a set height position outside the laterally-filled energy absorption layer, and the anti-jumping bullet-proof layer is of a tubular structure; and the main body support is disposed on the outermost and is used for packaging and supporting the drum body structure as a whole.

As a preferred way of the present disclosure, two or more annular step surfaces serving as a support guide layer are axially spaced and distributed on the inner surface of the explosion-proof drum for placing the support plate, so that adjustment of a height position of the support plate in the explosion-proof drum is achieved.

As a preferred way of the present disclosure, the laterally-filled energy absorption layer absorbs energy by adopting non-metal foam balls.

As a preferred way of the present disclosure, the laterally-filled energy absorption layer is in a form that a double-layer ball structure is combined with a single-layer ball structure: the double-layer ball structure is adopted from bottom to top at the set height position, and the single-layer ball structure is adopted above the double-layer ball structure.

As a preferred way of the present disclosure, through holes are distributed in the support plate.

As a preferred way of the present disclosure, for a movable explosive, the explosive is placed on the support plate and is transferred after being filled with the explosion-proof material.

In addition, the present disclosure provides a most popular using method for an intrinsic-safety explosive disposal and protection device; and a process for disposing an explosive by adopting the device includes:

step 1: firstly, determining heights of an explosive and a camouflage thereof to determine a height of a support plate in the protection device;

step 2: placing the support plate at the height position, determined in the above-mentioned step, in an explosion-proof drum;

step 3: filling an explosion-proof material above the support plate until reaching a set height of an energy absorption plate;

step 4: placing the energy absorption plate;

step 5: filling the explosion-proof material above the energy absorption plate until reaching a top cover;

step 6: covering the top cover; and step 7: lifting the protection device to cover the explosive.

Beneficial Effects (1) the explosive disposal and protection device in the present disclosure is completely prepared from the flexible composite material so as not to cause secondary damage even if excessive explosion occurs. In the present disclosure, due to the adoption of the flexible material and structure, intrinsic safety is realized. Specifically, it is unnecessary to touch the explosive due to a non-contact protection design, and therefore, a disposal way is intrinsically safe; and by designing the flexible material, no secondary damage is caused even if excessive explosion occurs due to misjudgment for an equivalent of the explosive, and therefore, it is also intrinsically safe;

(2) the support plate is disposed inside the device and is placed on the support guide layer, and thus, a position of the explosion-proof material filling layer placed on the support plate can be adjusted according to a size of an explosive to be disposed; in addition, in the case that the explosive is movable, the explosive can be placed on the support plate and is transported and transferred after being filled with the corresponding explosion-proof material. By virtue of the support plate and the filling of the explosion-proof material, a protection space of explosion-proof equipment can be utilized to the greatest extent, and the energy absorption material can be increased as much as possible, so as to realize efficient absorption for the energy from the shock waves;

(3) the energy absorption plate is disposed inside the device and is filled with the porous explosion-proof material, so that efficient absorption for the energy can be achieved, the energy from the shock waves can be rapidly dissipated within a limited range, the closer the porous explosion-proof material is to the explosive itself, the higher the consumption efficiency of the energy from the shock waves. At the same time, the energy absorption plate forms a Z-shaped structure together with a drum wall, so that a distance of an advancing process of the shock waves can be increased, and the shock waves can be better absorbed;

(4) the device is of a ⅄-shaped structure, and the shock waves can form a compression trend to the bottom of the structure at the moment when arriving at the structure, so that the shock waves leaking from the bottom are reduced, then, the jumping of the device is reduced, protection weakness at the bottom is avoided, the shock waves are guided to move to the top, and thus, non-contact disposal for the explosive is achieved; and (5) the energy absorption plate located on the top, structural wall surface and inside of the device forms a Z-shaped structure, which increases the distance of the advancing process of the shock waves inside the structure, so that the effect of dissipating the shock waves is enhanced, and the early overflow of the shock waves from a side face of the top of the equipment is avoided.

In which: 1—explosion-proof top cover; 2—support plate; 3—explosion-proof material filling layer; 4—explosion-proof drum; 5—energy absorption plate; 6—explosive;

1.1—top bullet-proof layer; 1.2—top explosion-proof layer; 1.3—top support structure layer;

4.1—explosion-proof liquid layer A; 4.2—support guide layer; 4.3—explosion-proof liquid layer B; 4.4—main bullet-proof layer; 4.5—lateral energy absorption layer; 4.6—anti-jumping bullet-proof layer; 4.7—main body support layer; 4.8—bottom barrier layer; 5.1—energy absorption plate main body; 5.2—top bullet-proof packaging material; and 5.3—high-impedance and high-damping filling material.

DETAILED DESCRIPTION OF THE EMBODIMENTS

The present disclosure will be further described in detail below with reference to the accompanying drawings and embodiments.

Embodiment 1

The embodiment provides an intrinsic-safety explosive disposal and protection device capable of realizing efficient absorption for energy from explosion shock waves, thereby implementing non-contact safety disposal for an explosive.

Figure 1:
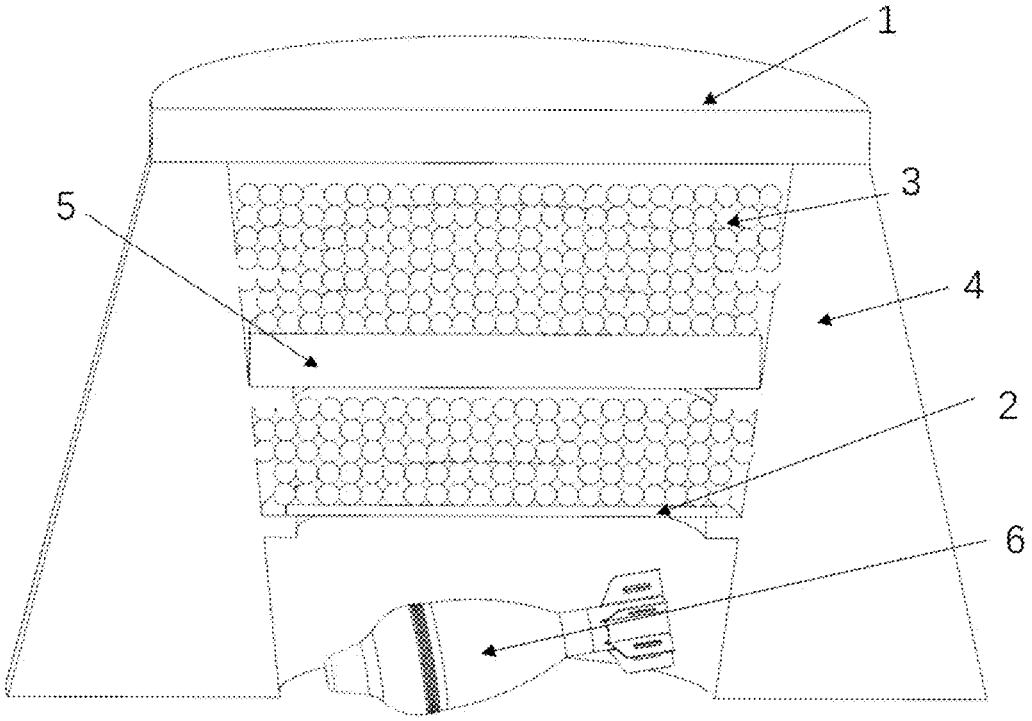
FIG. 1 is a schematic view of non-contact disposal for an unexploded ordnance by using a device in the present disclosure.
Figure 2:
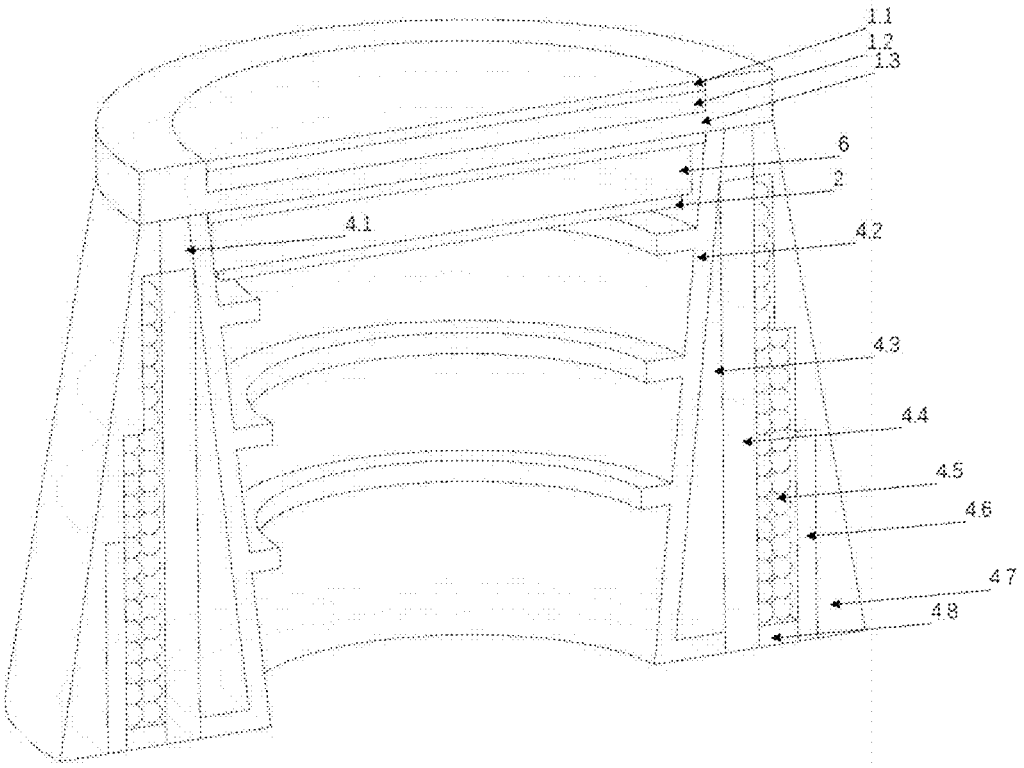
FIG. 2 is a sectional view of an intrinsic-safety explosive disposal and protection device in the present disclosure.

As shown in FIG. 1 and FIG. 2, the intrinsic-safety explosive disposal and protection device includes an explosion-proof top cover 1, a support plate 2, an explosion-proof material filling layer 3, an explosion-proof drum 4 and an energy absorption plate 5. The explosion-proof drum 4 is of a drum body structure having openings in two ends and a variable wall thickness gradually increased from top to bottom to form a ⋁-shaped structure (that is, an inner surface of the explosion-proof drum 4 is a conical surface with a top wider than a bottom, and an outer surface thereof is a conical surface with a top narrower than a bottom); and the explosion-proof top cover 1 is disposed on a top opening of the explosion-proof drum 4. The explosion-proof material filling layer 3 is disposed on the support plate 2 in the explosion-proof drum 4, and a height position of the support plate 2 in the explosion-proof drum 4 is adjustable; and an area located below the support plate 2 in the explosion-proof drum 4 is a placing area for an explosive 6. The energy absorption plate 5 is disposed in a middle of the explosion-proof material filling layer 3 and is generally located at a middle height position between the support plate 2 and the top cover 1, and the energy absorption plate 5 is connected to the inner surface of the explosion-proof drum 4 in a way of overlapping or bonding.

Figure 3:
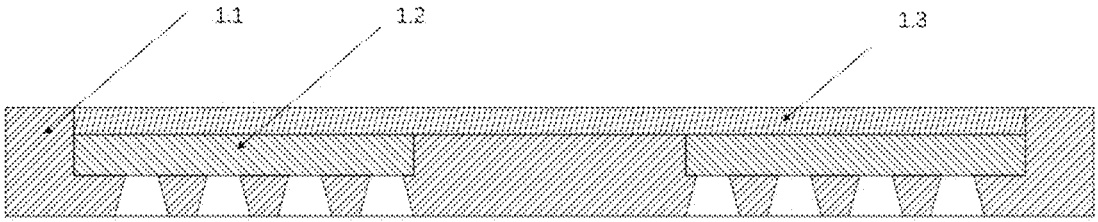
FIG. 3 is a sectional view of an explosion-proof top cover.

As shown in FIG. 3, the explosion-proof top cover 1 includes a top support layer 1.1, a top explosion-proof liquid layer 1.2 and a top bullet-proof layer 1.3. An annular groove is disposed in an upper surface of the top support layer 1.1, an annular bulge is provided in a middle of the annular groove, and a height of the annular bulge is smaller than a depth of the annular groove; and the top explosion-proof liquid layer 1.2 is of an annular structure with a central through hole, is located in the annular groove in the upper surface of the top support layer 1.1, and sleeves the annular bulge in the annular groove, and an upper surface of the top explosion-proof liquid layer 1.2 is flush with an upper surface of the annular bulge. The top bullet-proof layer 1.3 is of an annular flat plate structure and is disposed above the top explosion-proof liquid layer 1.2 in the annular groove in the upper surface of the top support layer 1.1, and an upper surface of the top bullet-proof layer 1.3 is flush with the upper surface of the top support layer 1.1. Through holes are distributed in a position, corresponding to the top explosion-proof liquid layer 1.2, on a lower surface of the top support layer 1.1, cross sections of the through holes are trapezoidal (that is, diameters of lower ends of the holes are larger than diameters of upper ends thereof), and a depth of each of the holes is consistent with a thickness of the top support layer 1.1 at the corresponding position.

Since the top explosion-proof liquid layer 1.2 in the explosion-proof top cover 1 is made to be of the annular structure with the central hole, on one hand, drooping to the center due to the self-gravity is avoided; and on the other hand, the formed ⋁-shaped structure can change a wave front of the shock waves, the shock waves are firstly converged to the middle and are prevented from overflowing from an edge of the top cover, and thus, the shock waves transversely propagated around are reduced. Trapezoidal holes are formed below the top support layer 1.1. Such solution has a further advantage of improving the effect on absorbing the shock waves.

As shown in FIG. 2, the explosion-proof drum 4 is of a multilayer structure and is sequentially provided with an inner support layer 4.2, an explosion-proof liquid layer 4.3, an inner bullet-proof layer 4.4, a laterally-filled energy absorption layer 4.5, an anti-jumping bullet-proof layer 4.6 and a main body support 4.7 from inside to outside.

The inner support layer 4.2 is of an inverted trapezoidal structure, that is, the diameter of an opening in a lower end is smaller than the diameter of an opening in an upper end; the lower end thereof extends outwards to form a shaft shoulder; and in addition, a plurality of annular step surfaces serving as a support guide layer are axially spaced and distributed on an inner surface of the inner support layer 4.2 for placing the support plate 2, so that adjustment of a height position of the support plate 2 in the explosion-proof drum 4 is achieved. The inner bullet-proof layer 4.4 is of a straight tubular structure coaxially sleeving the inner support layer 4.2, an inner surface of a lower end thereof is in contact linkage with the shaft shoulder at the lower end of the inner support layer 4.2, and an explosion-proof liquid is filled between the inner support layer 4.2 and the inner bullet-proof layer 4.4 to form an explosion-proof liquid layer B 4.3. A height of the inner bullet-proof layer 4.4 is smaller than that of the inner support layer 4.2, an explosion-proof liquid layer A 4.1 is disposed on a top of the inner bullet-proof layer 4.4, and the inner bullet-proof layer 4.4 has the same height as the explosion-proof liquid layer A 4.1 and the inner support layer 4.2. The top of the inner bullet-proof layer 4.4 is provided with the explosion-proof liquid layer which is easier to shed under the action of the shock waves and finally falls off under the action of gravity, thereby playing a better role in extinguishing flames of the overall structure.

The inner support layer 4.2 has an effect on guiding the shock waves and is of a ⋀-shaped structure with a bottom smaller than a top. Further, a bottom corner (i.e. the shaft shoulder extending outwards from the lower end at the bottom) may have a certain radian, and thus, the structure may be compressed when the shock waves arrive during explosion. The inner support layer 4.2 is of an elastomer structure made of rubber or sprayed with foam polyurea, and such structure may greatly deform under the action of an explosive load and be in contact with the ground to form a closed structure, thereby stopping a lifting effect of a subsequent detonation product on the structure, particularly stopping a lifting effect on the anti-jumping bullet-proof layer 4.6, reducing fragments leaking from the bottom, and improving the non-contact disposal ability of the explosion-proof equipment.

The inner support layer 4.2 is of the inverted trapezoidal structure, and therefore, the explosion-proof liquid layer B 4.3 filled between the inner support layer 4.2 and the inner bullet-proof layer 4.4 is in a form that the bottom thickness is larger than the top thickness. Such structural form is adopted due to a fact that during explosion on the ground, the shock waves are reflected by the ground, which causes a higher shock wave pressure at the bottom; and the situation that the structure is thicker at the bottom may reduce the jumping of the structure and uniformly absorb the energy from the shock waves at each height. By combining the explosion-proof liquid layer B 4.3 with the inner support layer 4.2, directions of the shock waves can be changed, and the shock waves can be guided upwards to be prevented from leaking from the bottom too early, and at the same time, the energy from the shock waves can be better absorbed.

The inner bullet-proof layer 4.4 is a main bullet-proof structural layer, is higher to prevent fragments from flying away, is protected by composite fiber to enable the fragments to be erected in a multi-layer fiber structure, and is mainly formed by one or a mixture of PE (polyethylene) fiber, aramid fiber and PBO (poly (p-phenylene benzobisoxazole)) fiber. Further, the inner bullet-proof layer 4.4 may be formed in a way of continuous winding.

The laterally-filled energy absorption layer 4.5 is disposed outside the inner bullet-proof layer 4.4, and the laterally-filled energy absorption layer 4.5 may absorb energy by adopting non-metal foam balls formed on the basis of foam such as polyurethane and polyimide. In the embodiment, the laterally-filled energy absorption layer 4.5 is in a form that a double-layer ball structure is combined with a single-layer ball structure, that is, the double-layer ball structure is adopted from bottom to top at the set height position, and the single-layer ball structure is adopted above the double-layer ball structure. The laterally-filled energy absorption layer 4.5 mainly absorbs the energy from the shock waves overflowing from the bottom, thereby reducing a lifting effect on the outer bullet-proof layer; and the laterally-filled energy absorption layer 4.5 may provide great deformation buffer space for the inner bullet-proof layer 4.4, so that the protection performance of a fiber material can be sufficiently utilized. The bottom of the laterally-filled energy absorption layer 4.5 is packaged by a bottom barrier layer 4.8, and the bottom barrier layer 4.8 may be made of an energy absorption foam plastic material such as a lightweight energy absorption foam material such as EPP, EPS or polyurethane foam.

The anti-jumping bullet-proof layer 4.6 is disposed from bottom to top at a set height position outside the laterally-filled energy absorption layer 4.5, and the anti-jumping bullet-proof layer 4.6 is of a tubular structure and is mainly used to prevent part of fragments from flying out of the bottom or prevent part of the fragments from flying away under the secondary loading of the detonation product after an internal structure is broken or a main body of the inner bullet-proof layer jumps; and the anti-jumping bullet-proof layer 4.6 is mainly made of one or a combination of bullet-proof fibers such as PE fiber, aramid fiber and PBO fiber and is preferably made of the PE fiber.

The main body support 4.7 is disposed on the outermost and is used for packaging and supporting the drum body structure 4 as a whole. Corresponding handles can be provided outside the main body support 4.7 to lift the structure, and the main body support 4.7 is made of a foam plastic material by adopting a specific die. Further, an open-cell hard flame-retardant polyurethane foam material can be preferably adopted.

The support plate 2 is disposed on the support guide layer inside the explosion-proof drum 4, and the support plate 2 is disposed according to a mechanism: when the explosive explodes, the fragments will have a certain flying angle; and in view of a safe distance, traditional explosion-proof equipment is generally higher to avoid a situation that the fragments fly out of the top to cause damage to surrounding personnel. A blank from the top end of the explosive to the top end of the traditional explosion-proof equipment is generally filled with air, and there is no energy absorption structure. In the solution, the support plate 2 is placed at a position, close to the height of the explosive 6, in the explosion-proof drum 4, and an energy absorption material (i.e. the explosion-proof material filling layer 3) is placed on the support plate 2, so that the energy from the shock waves can be more efficiently absorbed, and then, the protection space is prevented from being wasted. The support plate 2 is designed according to a principle that it is mainly made of a composite material such as one of a carbon fiber plate, a PC plate, a nylon plate and a foam plate and may have a certain rigidity to support the explosion-proof material on the top; elastomer such as polyurea and polyurethane is sprayed on the surface to form a relatively flexible protection layer; and further, foam may be sprayed with polyurea to form a support structure, and thus, destructive fragments cannot be formed even if the structure is broken by explosion shock waves. The support plate 2 has a porous structure, the holes can be set as many as possible when strength conditions are met, and the shock waves can be mixed with a filled energy absorption medium (i.e. the explosion-proof material filling layer 3) inside the drum 4 by the porous structure, so that an effect of efficient absorption is achieved.

The explosion-proof material filling layer 3 is of a low-density porous foam structure. In order to absorb the energy from the shock waves, for an explosion situation, a porous material is placed at a position closer to the explosive 6, and thus, the absorbed energy from the shock waves can be effectively changed. The explosion-proof material filling layer 3 is filled by adopting a plurality of separated structural bodies; and if a double-layer filling structure is adopted, low-density foam balls are used for filling at the bottom, and high-density foam balls may be adopted for filling on the top. If the explosive is higher, it can be considered that only the top explosion-proof balls are placed (that is, the support plate 2 is placed on the topmost support guide layer).

Figure 4:
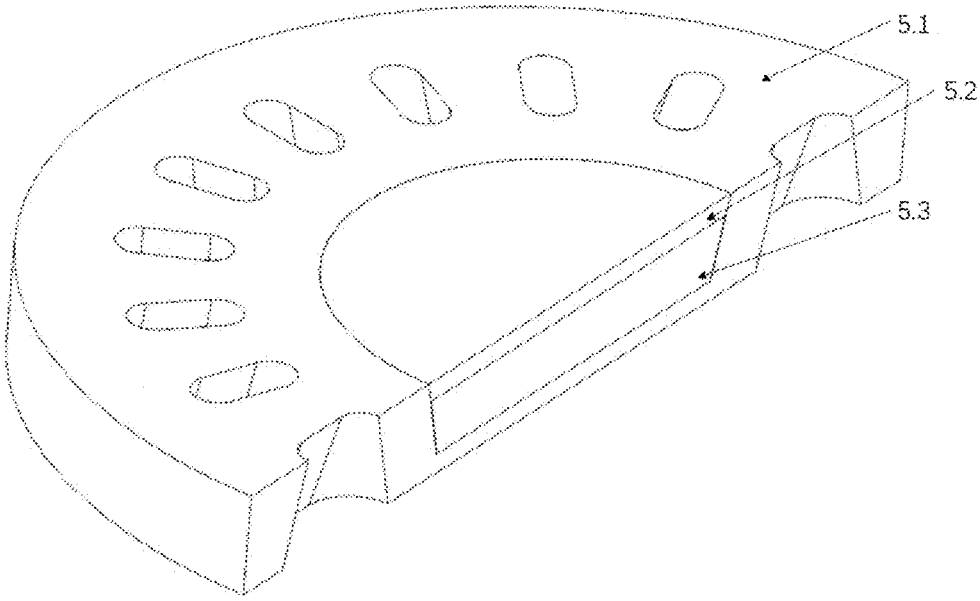
FIG. 4 is a schematic structural view of an energy absorption plate.

In addition, the energy absorption plate 5 shown in FIG. 4 is disposed inside the device; and the energy absorption plate 5 includes an energy absorption plate main body 5.1, a top bullet-proof packaging material 5.2 and a high-impedance and high-damping filling material 5.3. An annular groove is formed in a center of a surface of the energy absorption plate main body 5.1, trapezoidal holes (that is, diameters of lower ends of the holes are larger than diameters of upper ends thereof) are uniformly spaced and distributed in a circumferential direction of a periphery of the groove, and the trapezoidal holes may be filled with honeycomb sponge activated carbon (may be appropriately filled with a porous material with a very low density, and preferably an open-cell porous foam material).

The energy absorption plate main body 5.1 adopts an aerogel plate or porous polyurethane foam plate and is sprayed with a strengthening film for improving the strength. When the explosive explodes, firstly, an airflow upwards flows out of the trapezoidal holes, and the honeycomb sponge activated carbon in the trapezoidal holes can filter some harmful gases. Preferably, the density of the honeycomb sponge activated carbon is less than or equal to 50 kg/m$^3$, and the density of the plate is 100-300 kg/m$^3$.

The groove in the surface of the energy absorption plate main body 5.1 is filled with the high-impedance and high-damping filling material 5.3, and the high-impedance and high-damping filling material 5.3 may be one or a mixture of an explosion-proof liquid, dry water and a shear thickening liquid and has a density of 600 kg/m$^3$ to 1200 kg/m$^3$. The center of the energy absorption plate main body 5.1 is a liquid or powder material with higher impedance and damping, such as the explosion-proof liquid and the dry water, and two sides thereof are of trapezoidal hole structures; and the dry water or the explosion-proof liquid is higher in density, instantaneous effects of the shock waves may be upwards impacted from the trapezoidal holes in two sides after bypassing the high-impedance and high-damping material, and then, the shock waves are converged to the middle after meeting the explosion-proof liquid on the edge of the top cover, so that a propagation distance of the shock waves inside the structure is increased; and the shock waves are sufficiently mixed with the energy absorption material inside the structure and are then centrally delivered from the top, and thus, damage to the surrounding is reduced.

The top bullet-proof packaging material 5.2 is a packaging material disposed on the top of the groove in the surface of the energy absorption plate main body 5.1 and is used for packaging the high-impedance and high-damping filling material 5.3 therein. The top bullet-proof packaging material 5.2 may be one or a combination of PE fiber, aramid fiber and PBO fiber and may intercept the fragments generated when the explosive explodes, thereby reducing the risk that the fragments fly out of the top as much as possible.

When the device is not used, the support plate 2 is pasted by using a hook-and-loop fastener and is stored on a lower surface of the explosion-proof top cover 1 (as shown in FIG. 2). During use, the support plate 2 is placed on the support guide layer at the corresponding height position inside the explosion-proof drum 4 according to the size of the explosive 6, and then, the prepared explosion-proof filling material is placed on the support plate 2 for filling to form the explosion-proof material filling layer 3 (as shown in FIG. 1). In addition, if it is determined that the explosive is movable, the explosive can be placed on the support plate 2 and filled with the corresponding explosion-proof material, and is then transported and transferred.

Figure 5:
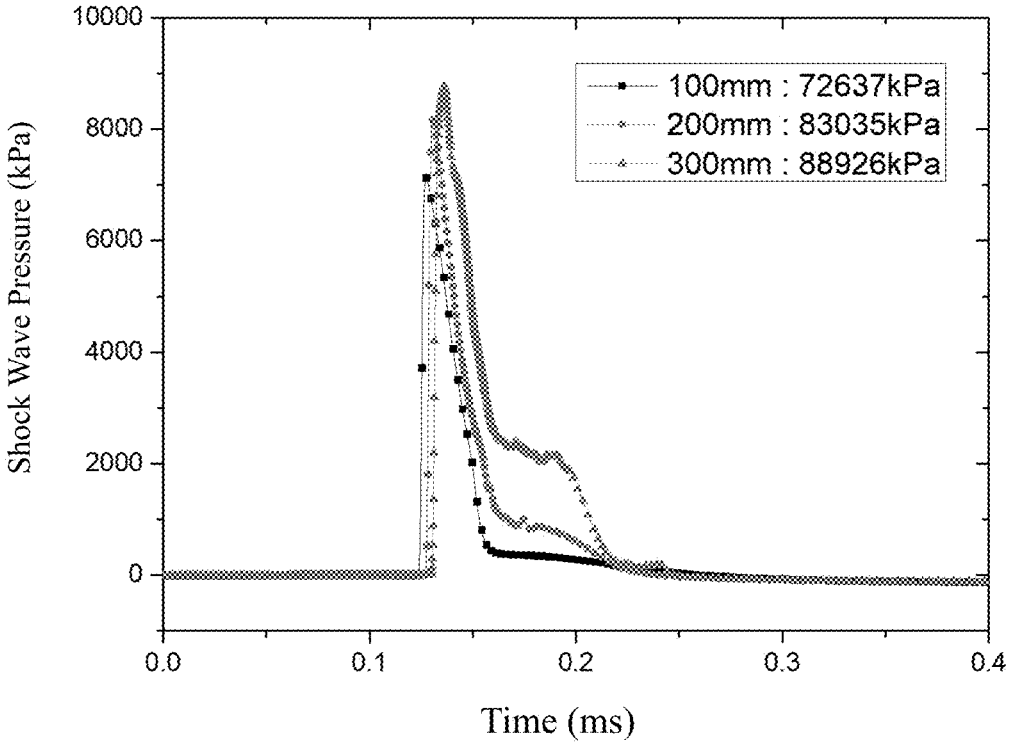
FIG. 5 shows a protection effect of an explosion-proof material for an explosive at different distances.

The protection efficiency of the shock waves at the position of the explosion-proof material is calculated by virtue of ANSYS-Autodyn explicit dynamic software. Calculation models of an explosive, an air domain and an explosion-proof material are established, a height from the bottom of the explosion-proof material to a bottom surface is 100 mm, 200 mm and 300 mm (a height from the bottom of the explosion-proof material to an upper surface of the explosive is 40 mm, 140 mm and 240 mm), and protection effects of the explosion-proof material at different distances on the explosive are determined by testing a shock wave pressure at a height 500 mm away from the bottom surface. As shown in FIG. 5, by calculating the pressure, it can be obviously seen that the closer the explosion-proof material is to the surface of the explosive, the higher the reduction rate of the shock wave pressure value by the porous foam material under the same conditions.

TABLE 1

| Position of test point | Test value of shock wave pressure | Reduction rate |
|---|---|---|
| 100 mm | 72637 kPa | 23.7% |
| 200 mm | 83035 kPa | 11.8% |
| 300 mm | 88926 kPa | 6.6% |
| Airburst | 95168 kPa | 0 |

Figure 6:
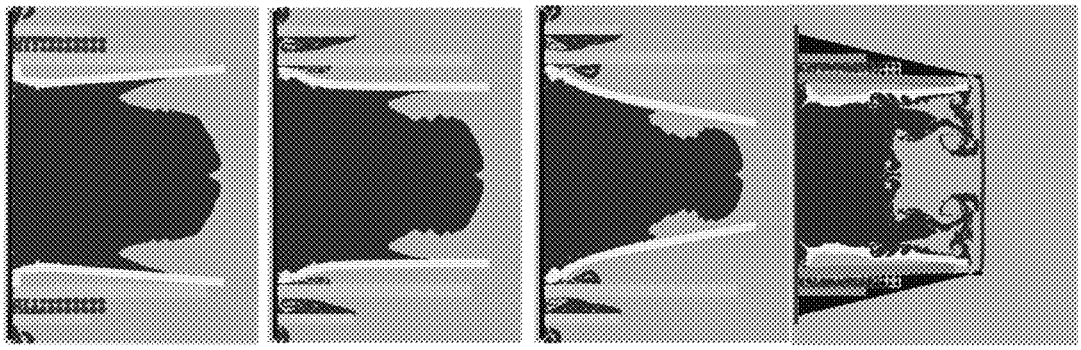
FIG. 6 and FIG. 7 are schematic views of a jumping speed of an anti-jumping bullet-proof layer under the action of different structures.
Figure 7:
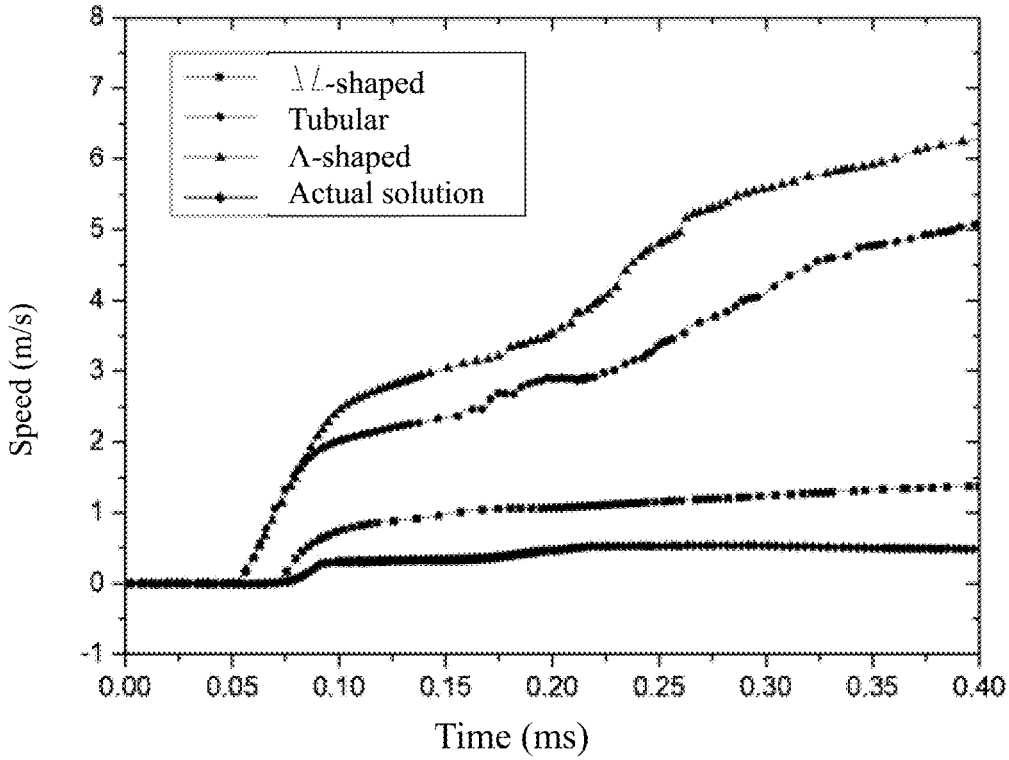
Figure 8:
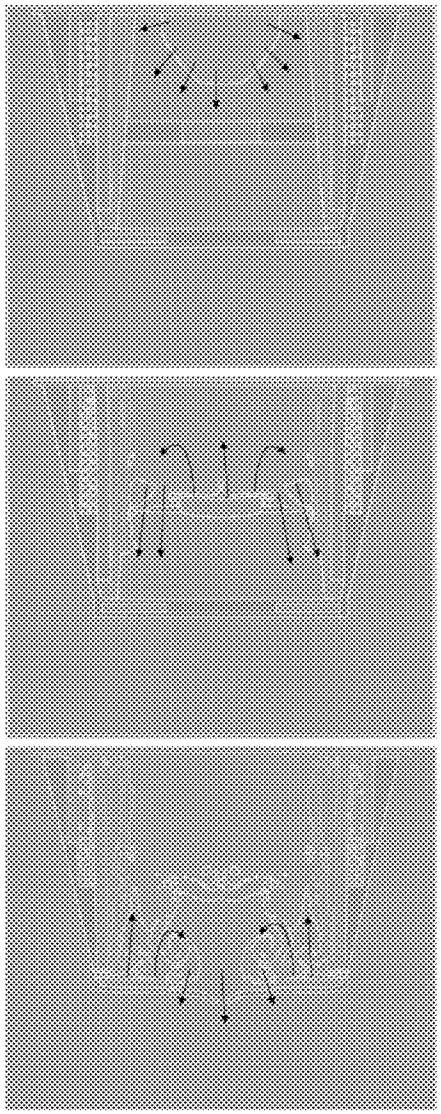
FIG. 8 shows movement situations of shock waves in an explosion-proof structure.

As shown in FIG. 6 and FIG. 7, by calculating an explosion-proof structure by virtue of the ANSYS-Autodyn explicit dynamic software, a jumping speed of the anti-jumping bullet-proof layer is compared under the actions of different structures. Calculation models of a ⟩⟨-shaped structure, a tubular structure, a Λ-shaped structure and a finally-designed explosion-proof structure are established. It can be seen that the \/-shaped structure can remarkably reduce the jumping speed of the anti-jumping bullet-proof layer. By the final structural design, the lowest speed (which is smaller than or equal to 0.5 m/s, the actual action time of the explosion shock waves is generally shorter than 10 ms, and the jumping height is smaller than 5 mm, so that fragment leakage caused by structural jumping is greatly reduced, and non-contact disposal for the explosive is realized) can be achieved.

Figure 9:
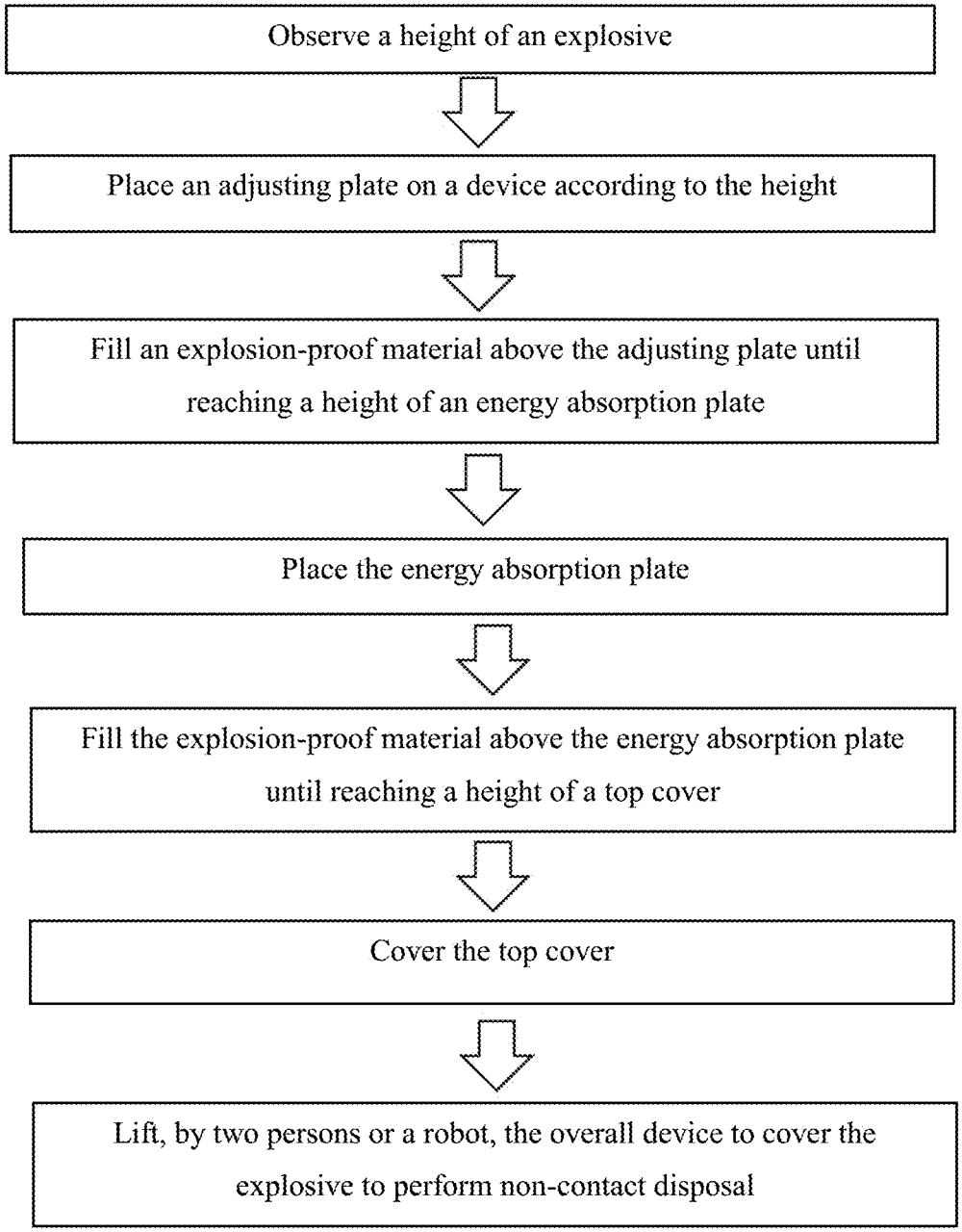
FIG. 9 is a view of a using process for a device.

In order to further describe movement states of the shock waves in the explosion-proof structure, a full model structure is established by virtue of the ANSYS-Autodyn explicit dynamic software to show movement situations of the shock waves in the explosion-proof structure. As shown in FIG. 9, firstly, the shock waves are outwards propagated in a semi-arc shape; the shock waves move to two sides after encountering the adjusted energy absorption plate, and are converged to the middle after encountering the explosion-proof liquid layer on the top, thereby centrally leaking outwards from the center of the top.

By the designed structure, a sample is processed for real explosion test. At the moment of explosion, flames are rapidly extinguished. It is observed by high-speed photography that fewer shock waves leak at the bottom, there is no obvious jumping on the overall structure, there is no fragment perforation in a pine authentication target, and the shock wave pressure at a safe distance is smaller than or equal to 20 kPa, which is lower than the standard of human injuries.

Embodiment 2

A process for disposing an explosive by adopting the device is further given on the basis of embodiment 1 mentioned as above.

As shown in FIG. 9, the process for disposing the explosive by adopting the device is described as follows:

(1) firstly, heights of the explosive 6 and a camouflage thereof are judged to determine a height of a support plate 2 in the protection device;

(2) the support plate 2 is placed on a support guide layer at the height position, determined in the above-mentioned step, in an explosion-proof drum 4;

(3) an explosion-proof material is filled above the support plate 2 until reaching the height of an energy absorption plate 5;

(4) the energy absorption plate 5 is placed, wherein generally speaking, a height of the energy absorption plate is ½ of a height between the support plate 2 and a top cover 1;

(5) the explosion-proof material is filled above the energy absorption plate 5 until reaching the top cover 1;

(6) the top cover 1 is covered to affirm that an overall structure is complete; and (7) two persons or a robot lifts the overall device to cover the explosive 6 to perform non-contact emergency disposal and protection, so that damage to the surrounding due to accidental explosion is avoided; and after protection, waiting for further decision from an explosive ordnance disposal expert is performed.

Although the present disclosure has been described in detail with general description and specific embodiments as above, some modifications or improvements can be made on the basis of the present disclosure, which is apparent for those skilled in the art. Therefore, these modifications or improvements made without departing from the spirit of the present disclosure fall within a scope of protection of the present disclosure.

What is claimed is:

1. An explosive disposal and protection device, comprising an explosion-proof top cover (1), an explosion-proof material filling layer (3), an explosion-proof drum (4) and an energy absorption plate (5) which are prepared from a flexible composite material;

the explosion-proof drum (4) being of a drum body structure having openings in two ends; the explosion-proof top cover (1) being disposed on a top opening of the explosion-proof drum (4); the energy absorption plate (5) being disposed at a set height position inside the explosion-proof drum (4); and an explosion-proof material being filled between the energy absorption plate (5) in the explosion-proof drum (4) and the explosion-proof top cover (1) to form the explosion-proof material filling layer (3).

2. The explosive disposal and protection device according to claim 1, further comprising a support plate (2); the support plate (2) being disposed below the energy absorption plate (5) in the explosion-proof drum (4), and an area located below the support plate (2) in the explosion-proof drum (4) being a placing area for an explosive (6); and a height of the support plate (2) in the explosion-proof drum (4) being adjustable.

3. The explosive disposal and protection device according to claim 2, wherein two or more annular step surfaces serving as a support guide layer are coaxially spaced and distributed on the inner surface of the explosion-proof drum (4) for placing the support plate (2), so that adjustment of a height position of the support plate (2) in the explosion-proof drum (4) is achieved.

4. The explosive disposal and protection device according to claim 2, wherein through holes are distributed in the support plate (2).

5. The explosive disposal and protection device according to claim 2, wherein for a movable explosive, the explosive is placed on the support plate (2) and is transferred after being filled with the explosion-proof material.

6. A method for using an explosive disposal and protection device, wherein the explosive disposal and protection device is the explosive disposal and protection device according to claim 2, the method comprising:

step 1: determining heights of the explosive (6) and a camouflage thereof to determine a height of a support plate (2) in the protection device;

step 2: placing the support plate (2) at the height position, determined in the above-mentioned step, in an explosion-proof drum (4);

step 3: filling an explosion-proof material above the support plate (2) until reaching a set height of an energy absorption plate (5);

step 4: placing the energy absorption plate (5);

step 5: filling the explosion-proof material above the energy absorption plate (5) until reaching a top cover (1);

step 6: covering the top cover (1); and step 7: lifting the protection device to cover the explosive (6).

7. The explosive disposal and protection device according to claim 1, wherein the energy absorption plate (5) comprises an energy absorption plate main body (5.1), a top bullet-proof packaging material (5.2) and a high-impedance and high-damping filling material (5.3);

an annular groove is provided in a center of a surface of the energy absorption plate main body (5.1), trapezoidal holes are uniformly spaced and distributed in a circumferential direction of a periphery of the groove, and the trapezoidal holes are filled with an open-cell porous foam material;

the groove in the surface of the energy absorption plate main body (5.1) is filled with the high-impedance and high-damping filling material (5.3); and the top bullet-proof packaging material (5.2) is a packaging material disposed on a top of the groove in the surface of the energy absorption plate main body (5.1) and is used for packaging the high-impedance and high-damping filling material (5.3) therein.

8. The explosive disposal and protection device according to claim 1, wherein the explosion-proof top cover (1) comprises a top support layer (1.1), a top explosion-proof liquid layer (1.2) and a top bullet-proof layer (1.3);

an annular groove is disposed in an upper surface of the top support layer (1.1), an annular bulge is provided in a middle of the annular groove, and a height of the annular bulge is smaller than a depth of the annular groove;

the top explosion-proof liquid layer (1.2) is of an annular structure with a central through hole, is located in the annular groove in the upper surface of the top support layer (1.1), and sleeves the annular bulge in the annular groove;

the top bullet-proof layer (1.3) is of an annular flat plate structure and is disposed above the top explosion-proof liquid layer (1.2) in the annular groove in the upper surface of the top support layer (1.1); and trapezoidal through holes are distributed in a position, corresponding to the top explosion-proof liquid layer (1.2), on a lower surface of the top support layer (1.1), and a depth of each of the trapezoidal through holes is consistent with a thickness of the top support layer (1.1) at the corresponding position.

9. The explosive disposal and protection device according to claim 1, wherein the explosion-proof drum (4) is of a drum body structure with a variable wall thickness gradually increased from top to bottom; and an inner surface of the explosion-proof drum (4) is a conical surface with a top wider than a bottom, and an outer surface thereof is a conical surface with a top narrower than a bottom.

10. The explosive disposal and protection device according to claim 9, wherein the explosion-proof drum (4) is sequentially provided with an inner support layer (4.2), an explosion-proof liquid layer (4.3), an inner bullet-proof layer (4.4), a laterally-filled energy absorption layer (4.5), an anti-jumping bullet-proof layer (4.6) and a main body support (4.7) from inside to outside;

the inner support layer (4.2) is of an inverted trapezoidal structure, and a lower end thereof extends outwards to form a shaft shoulder; the inner bullet-proof layer (4.4) is of a straight tubular structure coaxially sleeving the inner support layer (4.2), an inner surface of a lower end thereof is in contact linkage with the shaft shoulder at the lower end of the inner support layer (4.2), and an explosion-proof liquid is filled between the inner support layer (4.2) and the inner bullet-proof layer (4.4) to form an explosion-proof liquid layer B (4.3); an explosion-proof liquid layer A (4.1) is disposed on a top of the inner bullet-proof layer (4.4), and the inner bullet-proof layer (4.4) has the same height as the explosion-proof liquid layer A (4.1) and the inner support layer (4.2);

the laterally-filled energy absorption layer (4.5) is disposed outside the inner bullet-proof layer (4.4), and a bottom of the laterally-filled energy absorption layer (4.5) is packaged by a bottom barrier layer (4.8);

the anti-jumping bullet-proof layer (4.6) is disposed from bottom to top at a set height position outside the laterally-filled energy absorption layer (4.5), and the anti-jumping bullet-proof layer (4.6) is of a tubular structure; and the main body support (4.7) is disposed on the outermost and is used for packaging and supporting the drum body structure (4) as a whole.

11. The explosive disposal and protection device according to claim 10, wherein the laterally-filled energy absorption layer (4.5) absorbs energy by adopting non-metal foam balls.

12. The explosive disposal and protection device according to claim 11, wherein the laterally-filled energy absorption layer (4.5) is in a form that a double-layer ball structure is combined with a single-layer ball structure: the double-layer ball structure is adopted from bottom to top at the set height position, and the single-layer ball structure is adopted above the double-layer ball structure.

* * * * *